US007419138B1

(12) United States Patent
Mauthner

(10) Patent No.: US 7,419,138 B1
(45) Date of Patent: Sep. 2, 2008

(54) SELF-CAMMING PULLEY

(75) Inventor: Kirk M. Mauthner, Invermere (CA)

(73) Assignee: CMC Rescue, Inc., Santa Barbara, CA (US)

( * ) Notice: Subject to any disclaimer, the term of this patent is extended or adjusted under 35 U.S.C. 154(b) by 0 days.

(21) Appl. No.: 11/710,865

(22) Filed: Feb. 23, 2007

(51) Int. Cl.
*B66D 3/08* (2006.01)

(52) U.S. Cl. ..... 254/394; 254/391; 254/408

(58) Field of Classification Search ..... 254/391, 254/393, 394, 398, 408
See application file for complete search history.

(56) References Cited

U.S. PATENT DOCUMENTS

| | | | | | |
|---|---|---|---|---|---|
| 10,688 | A | | 3/1854 | Webber | |
| 147,625 | A | | 2/1874 | Floyd | |
| 152,270 | A | * | 6/1874 | Bird | 254/391 |
| 152,635 | A | | 6/1874 | Hewitt et al. | |
| 210,281 | A | | 11/1878 | Weston | |
| 411,240 | A | | 9/1889 | Dunn | |
| 476,078 | A | | 5/1892 | Rousseau | |
| 524,403 | A | | 8/1894 | Rowland | |
| 538,584 | A | | 4/1895 | Hartz | |
| 785,358 | A | | 3/1905 | Gutenkunst | |
| 828,380 | A | | 8/1906 | Burbank | |
| 1,240,966 | A | * | 9/1917 | Gould | 24/134 R |
| 1,328,717 | A | | 1/1920 | Coates | |
| 1,671,435 | A | | 5/1928 | McKissick | |
| 1,796,250 | A | | 3/1931 | Greve | |
| 1,828,897 | A | | 10/1931 | Hollingsworth | |
| 2,187,361 | A | | 1/1940 | Palsson | |
| 2,511,729 | A | | 6/1950 | Maier | |
| 2,638,184 | A | | 5/1953 | Sturdivant | |
| 2,780,318 | A | * | 2/1957 | Owens | 254/391 |
| 3,663,992 | A | * | 5/1972 | Vittert | 254/391 |
| 3,756,565 | A | * | 9/1973 | Sakai | 254/391 |
| 3,814,210 | A | | 6/1974 | Hoffman | |
| 4,097,023 | A | | 6/1978 | Muller | |
| D252,069 | S | | 6/1979 | Nava et al. | |
| 4,264,056 | A | | 4/1981 | Singer | |
| 4,332,372 | A | * | 6/1982 | Singer | 254/391 |
| 4,466,599 | A | | 8/1984 | Singer | |
| 4,872,632 | A | * | 10/1989 | Johnson | 248/332 |
| 4,923,037 | A | * | 5/1990 | Stephenson et al. | 188/188 |
| 5,054,577 | A | | 10/1991 | Petzl et al. | |
| 5,577,576 | A | | 11/1996 | Petzl et al. | |
| 5,664,640 | A | | 9/1997 | Smith | |
| 5,868,380 | A | * | 2/1999 | Allen | 254/391 |
| 5,927,438 | A | | 7/1999 | Ostrobrod | |

(Continued)

FOREIGN PATENT DOCUMENTS

| | | |
|---|---|---|
| DE | 2121814 B | 11/1971 |

(Continued)

*Primary Examiner*—Emmanuel M Marcelo
(74) *Attorney, Agent, or Firm*—Christie, Parker & Hale, LLP.

(57) ABSTRACT

A pulley is provided having a first plate and a second plate arranged adjacent to the first plate and connected to the first plate by an axle. An eccentrically mounted sheave is located between the first plate and the second plate and is adapted to freewheel in one direction only. The eccentrically mounted sheave is mounted eccentrically with respect to the axle. A fixed block is mounted between the first plate and the second plate and is adapted to fixedly lock a line between the fixed block and the eccentrically mounted sheave.

20 Claims, 10 Drawing Sheets

U.S. PATENT DOCUMENTS

| | | | | |
|---|---|---|---|---|
| D431,448 | S | 10/2000 | Mihailovic | |
| 6,189,867 | B1 | 2/2001 | O'Rourke et al. | |
| 6,902,031 | B2 * | 6/2005 | Ador | 182/5 |

FOREIGN PATENT DOCUMENTS

| | | | |
|---|---|---|---|
| DE | 3137984 | A | 4/1983 |
| EP | 0803268 | A1 | 10/1997 |
| EP | 1329242 | A1 | 7/2003 |
| FR | 2604988 | A | 4/1988 |

* cited by examiner

SELF-CAMMING PULLEY

BACKGROUND OF THE INVENTION

1. Field of the Invention

The present invention relates generally to a pulley, and more particularly, to a self-camming or self rope-locking pulley.

2. Description of Related Art

Pulleys are generally known in the art. A pulley is a wheel or sheave with a groove along its edge for holding a line, such as a rope, cable, cord, or chain. A pulley may be used in a number of configurations. One such configuration is the block and tackle arrangement in which two pulleys work in unison, one pulley being fixed and another moving with the load. The simplest of pulleys includes a sheave or sheaves that all freewheel in both clockwise and counter-clockwise directions. More sophisticated pulleys provide locking mechanisms so that a load is locked in place when a force on a line carried by the sheaves is released. Such locking sheave features are disclosed in U.S. Pat. Nos. 6,189,867; 5,927,438; and 5,868,380, which are herein incorporated by reference.

Some pulleys also include cord extensions for releasing the load. With such pulleys, the user typically has to raise the load slightly with the pulley system to take pressure off a toothed cam before the user can completely move the cam out of the way to allow releasing or lowering of the load. For such pulleys, see U.S. Pat. Nos. 5,664,640 and 5,927,438, which are herein incorporated by reference.

While pulleys with locking mechanisms and cord extensions for releasing a load are known in the art, there is a need for a self-camming pulley with an improved locking mechanism and release mechanism for a controllable release under a load.

SUMMARY OF THE INVENTION

In an exemplary embodiment of the present invention, a self-camming pulley is provided. The pulley includes a first plate and a second plate arranged adjacent to the first plate and connected to the first plate by an axle. An eccentrically mounted sheave is located between the first plate and the second plate and is adapted to freewheel in one direction only. The eccentrically mounted sheave is mounted eccentrically with respect to the axle and is adapted to support a line. A fixed block is mounted between the first plate and the second plate and is adapted to fixedly lock a line between the fixed block and the eccentrically mounted sheave.

In another exemplary embodiment of the present invention the eccentrically mounted sheave is adapted to move closer to the fixed block when the eccentrically mounted sheave is rotated in a direction opposite said one direction, and to move farther from the fixed block when the eccentrically mounted sheave is rotated in said one direction.

In another exemplary embodiment of the present invention, the pulley includes a lever coupled to the eccentrically mounted sheave and adapted to move from a first position to a second position when the eccentrically mounted sheave is rotated in the direction opposite said one direction. The lever is also adapted to rotate the eccentrically mounted sheave in said one direction as the lever is moved from the second position to the first position. The lever includes an eye for attaching a cord extension.

In another exemplary embodiment of the present invention, the pulley includes a torsion spring connected between the lever and the second plate. The torsion spring is adapted to bias the lever from the first position to the second position when a line carried by the eccentrically mounted sheave is released.

In another exemplary embodiment of the present invention, the pulley includes a main block connecting the first plate and the second plate together at a top portion of the first plate and the second plate.

In another exemplary embodiment of the present invention, the pulley includes an eyebolt connected to a top of the main block, the eyebolt being adapted to swivel.

In another exemplary embodiment of the present invention, the second plate contains an eye in a bottom portion.

In another exemplary embodiment of the present invention, the pulley includes a third plate arranged adjacent to the second plate. The third plate is attached to the first plate and the second plate by the main block and the axle. A concentrically mounted sheave is located between the second plate and the third plate and is adapted to freewheel in both clockwise and counter-clockwise directions. The concentrically mounted sheave is mounted concentrically with respect to the axle.

In another exemplary embodiment of the present invention, a two-way bearing is mounted within the concentrically mounted sheave for allowing the concentrically mounted sheave to freewheel in both clockwise and counter-clockwise directions.

In another exemplary embodiment of the present invention, a one-way bearing is mounted within the eccentrically mounted sheave for allowing the eccentrically mounted sheave to freewheel in one direction only. A sheave hub is mounted within the one-way bearing. The sheave hub has a sheave hub dowel pin hole and a sheave hub axle hole located off of a center of the sheave hub. The sheave hub, the one-way bearing, and the eccentrically mounted sheave are concentric to one another and are mounted eccentrically with respect to the axle through the sheave hub axle hole. A dowel pin is inserted into the sheave hub dowel pin hole and connected to the lever.

In another exemplary embodiment of the present invention, a ratchet and pawl is mounted within the eccentrically mounted sheave for allowing the eccentrically mounted sheave to freewheel in one direction only. A sheave hub is mounted within the ratchet and pawl, the sheave hub having a sheave hub dowel pin hole and a sheave hub axle hole located off of a center of the sheave hub. The sheave hub, the one-way bearing, and the eccentrically mounted sheave are concentric to one another and are mounted eccentrically with respect to the axle through the sheave hub axle hole. A dowel pin is inserted into the sheave hub dowel pin hole and connected to the lever.

In another exemplary embodiment of the present invention, the first plate, the second plate, and the third plate extend beyond the concentrically mounted sheave and eccentrically mounted sheave in order to protect a line carried by the concentrically mounted sheave and eccentrically mounted sheave from external abrasion.

In another exemplary embodiment of the present invention, the main block includes protrusions for fitting into corresponding protrusion openings of the first plate, the second plate, and the third plate, and the fixed block includes protrusions for fitting into corresponding protrusion openings of the first plate and the second plate.

In another exemplary embodiment of the present invention, the concentrically mounted sheave has a rounded inner surface and the eccentrically mounted sheave has an angular inner surface.

DETAILED DESCRIPTION

Figure 1:
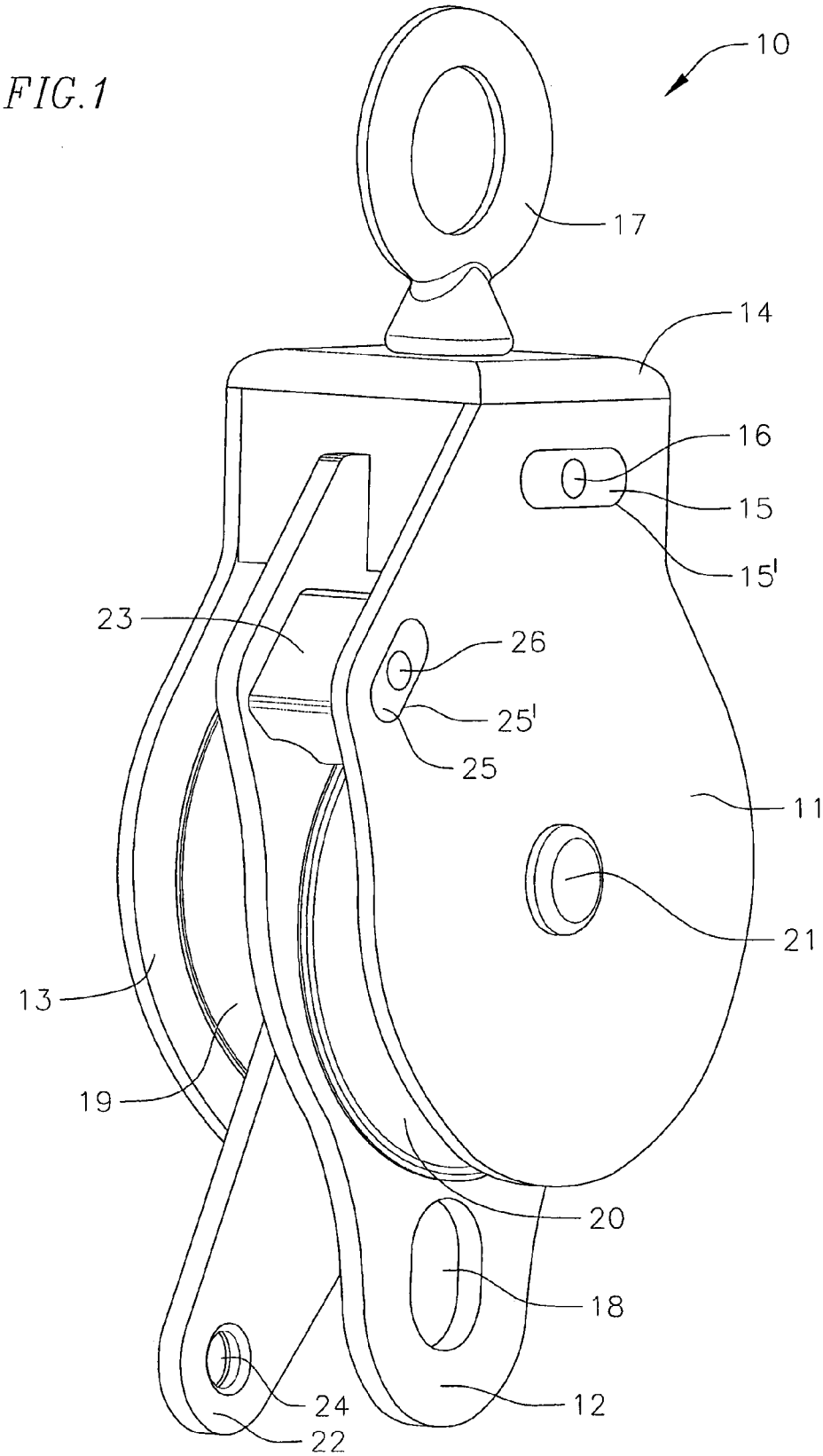
FIG. 1 is a front perspective view of a self-camming pulley according to an exemplary embodiment of the present invention.

FIG. 1 is a front perspective view of a self-camming pulley 10 according to an exemplary embodiment of the present invention. The self-camming pulley 10 includes front plate 11, middle plate 12, and rear plate 13. The front, middle, and rear plates 11, 12, 13 may be formed of metal, such as aluminum or stainless steel. Stainless steel plates provide high strength and excellent environmental resistance. Aluminum plates have a lighter weight and are generally formed to be thicker, which allow for a more rounded edge than plates formed of stainless steel. The front, middle, and rear plates 11, 12, 13 may extend out beyond sheaves 19, 20 in order to protect a line from external abrasion. The line may be a rope, cord, or the like. Middle plate 12 may contain an eye 18 (also called a becket) at a bottom portion for allowing an end of a rope to be attached.

The front, middle, and rear plates 11, 12, 13 are joined together at a top portion by a main block 14. The main block 14 may also be formed of metal, such as stainless steel or aluminum. The main block 14 includes protrusions 15 that insert into corresponding protrusion openings 15' in the front and rear plates 11, 13. The protrusions 15 and corresponding protrusion openings 15' improve the strength of the pulley apparatus 10 and allow for a proper alignment of the front and rear plates 11, 13 to the main block 14.

The main block 14 may additionally include holes 16 so that bolts may fix the front and rear plates 11, 13 to the main block 14. The top of the main block 14 may include an additional hole for allowing a swiveling eyebolt 17 to attach. The eyebolt 17 may be formed of aluminum or steel. The eyebolt 17 has a ring-shaped head designed to receive a hook, rope, or carabiner. The eyebolt 17 swivels, which allows the self-camming pulley 10 in a block and tackle arrangement to orient properly to the operator and also to relieve potential rotational forces that the pulley system may apply to its anchorage.

Figure 2:
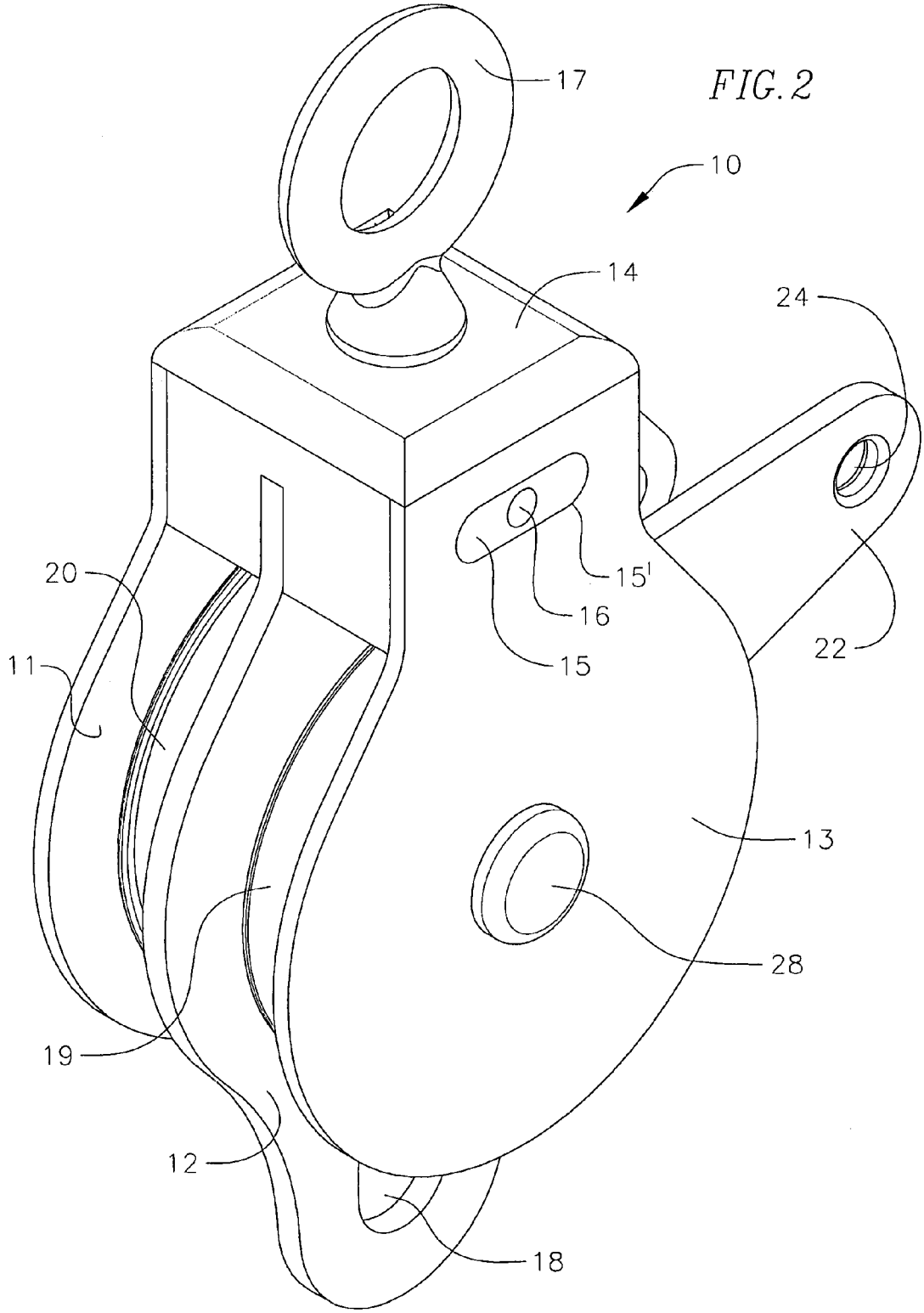
FIG. 2 is a rear perspective view of the self-camming pulley according to an exemplary embodiment of the present invention.

The sheaves 19, 20 are located between the middle and rear plates 12, 13, and front and middle plates 11, 12, respectively. Sheaves 19, 20 may also be formed of metal. Sheave 19 is concentrically mounted with respect to front axle 21 between middle and rear plates 12, 13 and its bearing allows for freewheeling in both directions. Sheave 20 is eccentrically mounted with respect to the front axle 21 between front and middle plates 11, 12 and its bearing allows for freewheeling in one direction only. As viewed from a front end as depicted in FIG. 1, the sheave 20 freewheels only in the counter-clockwise direction. The eccentrically mounted sheave 20 is connected internally to release arm lever 22. When the lever 22 is in a lower position, as depicted in FIG. 1, the sheave 20 is located farther from fixed block/brake pad 23 than when the lever is in an upper position (as depicted in FIG. 2). As the lever 22 is moved from a lower position to an upper position, the sheave 20 counter rotates (rotates in a clockwise direction when viewed from a front end as depicted in FIG. 1) as it moves closer to the fixed block/brake pad 23. Thus, the sheave 20 may be moved closer to the fixed block/brake pad 23 by either moving the lever 22 from a lower position to an upper position or by counter rotating the sheave 20.

When the sheave 20 is closest to the fixed block/brake pad 23, the lever 22 will be in an upper position, and rope between the fixed block/brake pad 23 and the sheave 20 will be held locked in a fixed position. Thus, when the self-camming pulley 10 is in a block and tackle arrangement, the self-camming pulley 10 will allow for smooth, efficient, one-way travel of the rope through the sheaves when raising loads, yet will lock the rope to prevent travel in the releasing direction. The lever 22 includes an eye 24 for attaching a cord extension for controllably releasing the locked rope, even under load. That is, by pulling the cord attached to eye 24 of the lever 22, the lever 22 is moved to a lower position, as depicted in FIG. 1, which moves sheave 20 farther from the fixed block/brake pad 23 such that a rope pinched between the fixed block/brake pad 23 and the sheave 20 is disengaged.

The fixed block/brake pad 23 may also include protrusions 25 that insert into corresponding protrusion openings 25' for providing additional strength and for allowing proper alignment with the front and middle plates 11, 12. The fixed block/brake pad 23 may additionally include a hole 26 for allowing the front and middle plates 11, 12 and fixed block/brake pad 23 to be secured together.

Figure 9:
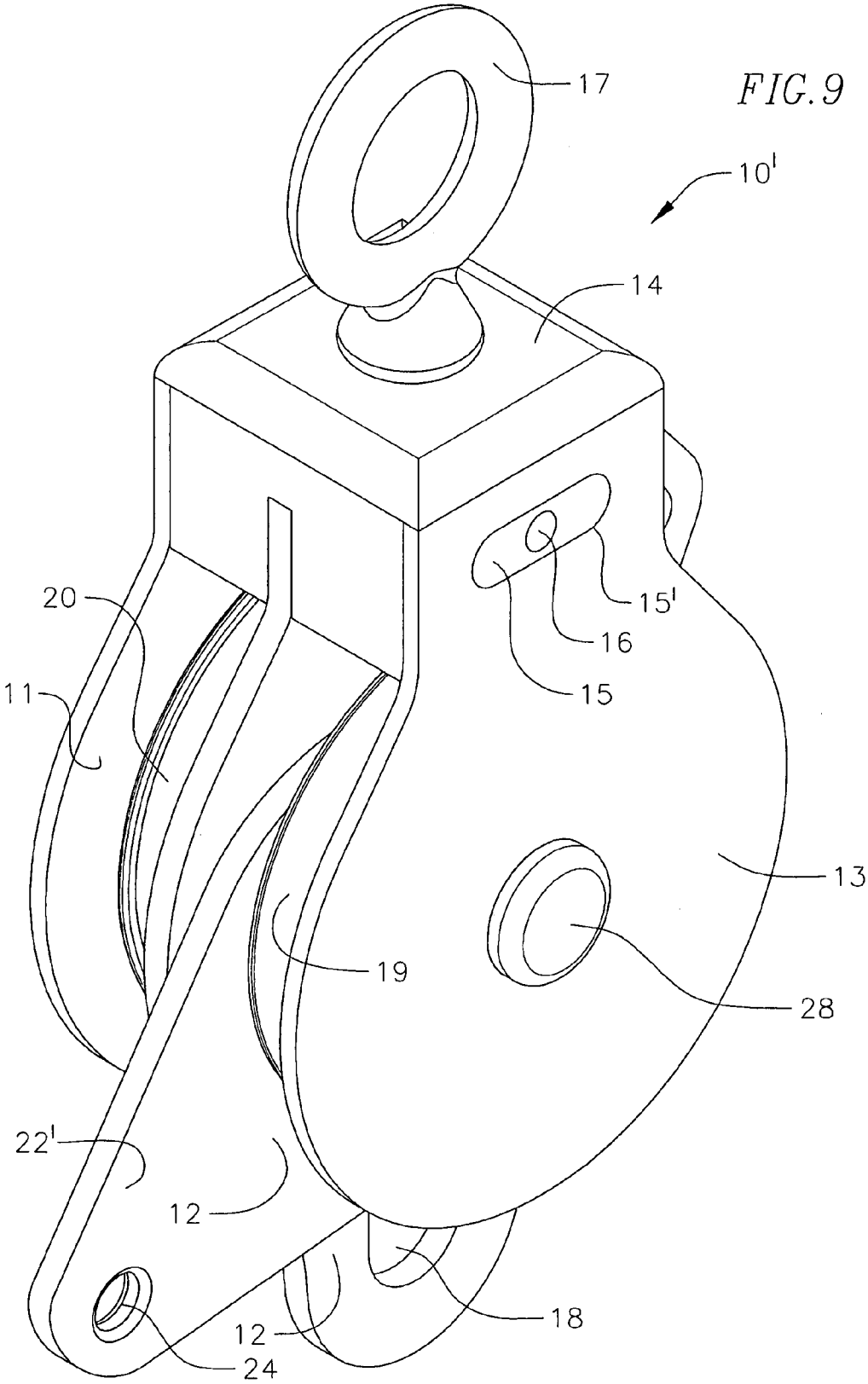
FIG. 9 is a rear perspective view of a self-camming pulley according to yet another exemplary embodiment of the present invention.

As shown in FIG. 1, the lever 22 is located between the middle and rear plates 12, 13, but the lever 22 may alternatively be located between front and middle plates 11, 12. Furthermore, the lever 22 may alternatively be located on an opposite side of the pulley 10, as shown in FIG. 9. The self-camming pulley has been described having metal components, such as the plates and the sheaves, however the plates and sheaves may alternatively be formed of plastic or nylon. Plates or sheaves formed of plastic allow for a lighter weight pulley, but at the sacrifice of strength, as they could deform under heavy load.

FIG. 2 is a rear perspective view of the self-camming pulley 10 according to an exemplary embodiment of the present invention. The front, middle, and rear plates 11, 12, 13 are secured together by the main block 14, front axle 21 (see FIG. 1), and rear axle 28. Lever 22 is shown in an upper position. The main block 14 also includes protrusions 15 that insert into corresponding protrusion openings 15' for increasing the strength of the attachment and providing proper alignment. The front and rear plates 11, 13 may be secured to the main block 14 with a bolt that inserts into hole 16 of the main block 14. The bolt head should have a larger diameter than the width of the protrusion openings 15', 25' of the plates.

Figure 3:
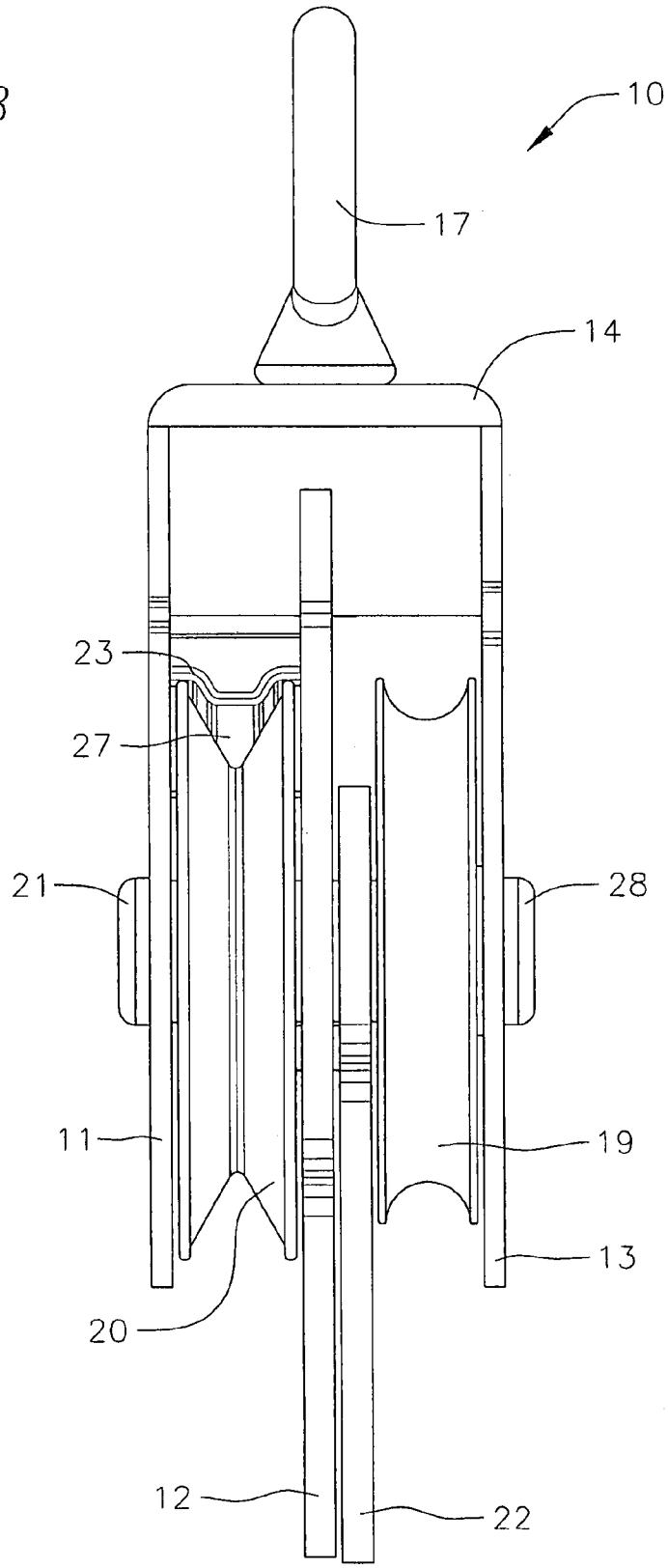
FIG. 3 is a rear side view of the self-camming pulley according to an exemplary embodiment of the present invention.

FIG. 3 is a rear side view of the self-camming pulley 10 according to an exemplary embodiment of the present invention. As shown in FIG. 3, the concentrically mounted sheave 19 has a rounded inner surface and the eccentrically mounted sheave 20 has an angular V-shaped inner surface. The rounded inner surface of the sheave 19 minimizes efficiency losses while bending a rope around a sheave. The rounded convex inner surface of the sheave 19 has a diameter approximately equal to or slightly larger than a diameter of a rope used with the self-camming pulley 10. On the other hand, the angular V-shaped inner surface of sheave 20 maximizes the friction applied to the smooth rope contact surface of the sheave 20 when the sheave 20 is counter rotated, thereby providing the necessary torque to effectuate rope-locking. The sheave 20 is also formed such that the fixed block/brake pad 23, which includes a flange 27 protruding from a center portion in the direction of the sheave 20, may properly compress, pinch, squeeze, or trap a rope carried by sheave 20, thereby fixedly locking the rope between the sheave 20 and the fixed block/brake pad 23.

Figure 4:
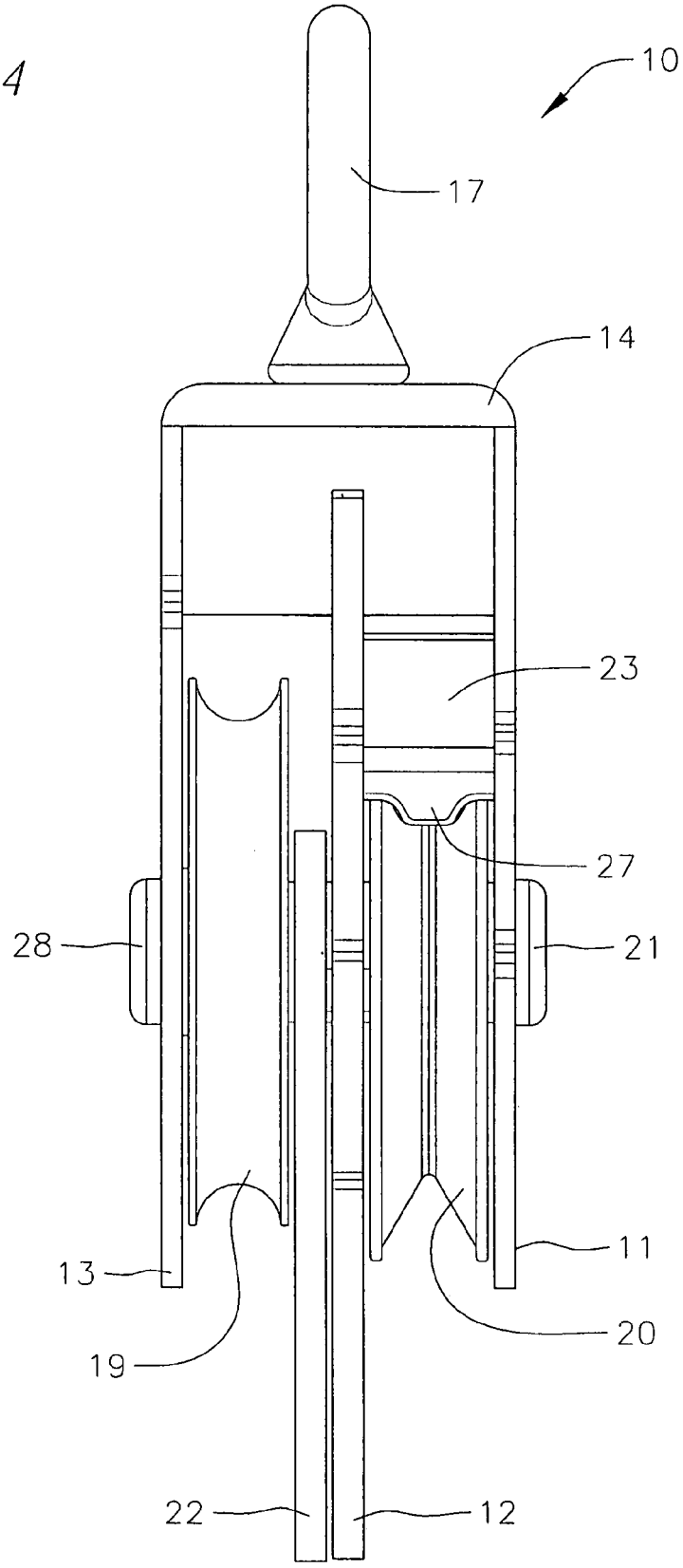
FIG. 4 is a front side view of the self-camming pulley according to an exemplary embodiment of the present invention.

FIG. 4 is a front side view of the self-camming pulley 10 according to an exemplary embodiment of the present invention. As discussed above in relation to FIG. 3, the fixed block/brake pad 23 includes a flange 27 protruding from a center portion in the direction of the sheave 20. The angular inner surface of the sheave 20 and the protruding flange 27 are formed so as to lock a rope carried by sheave 20 as sheave 20 counter rotates or as lever 22 is moved into an upper position.

Figure 5:
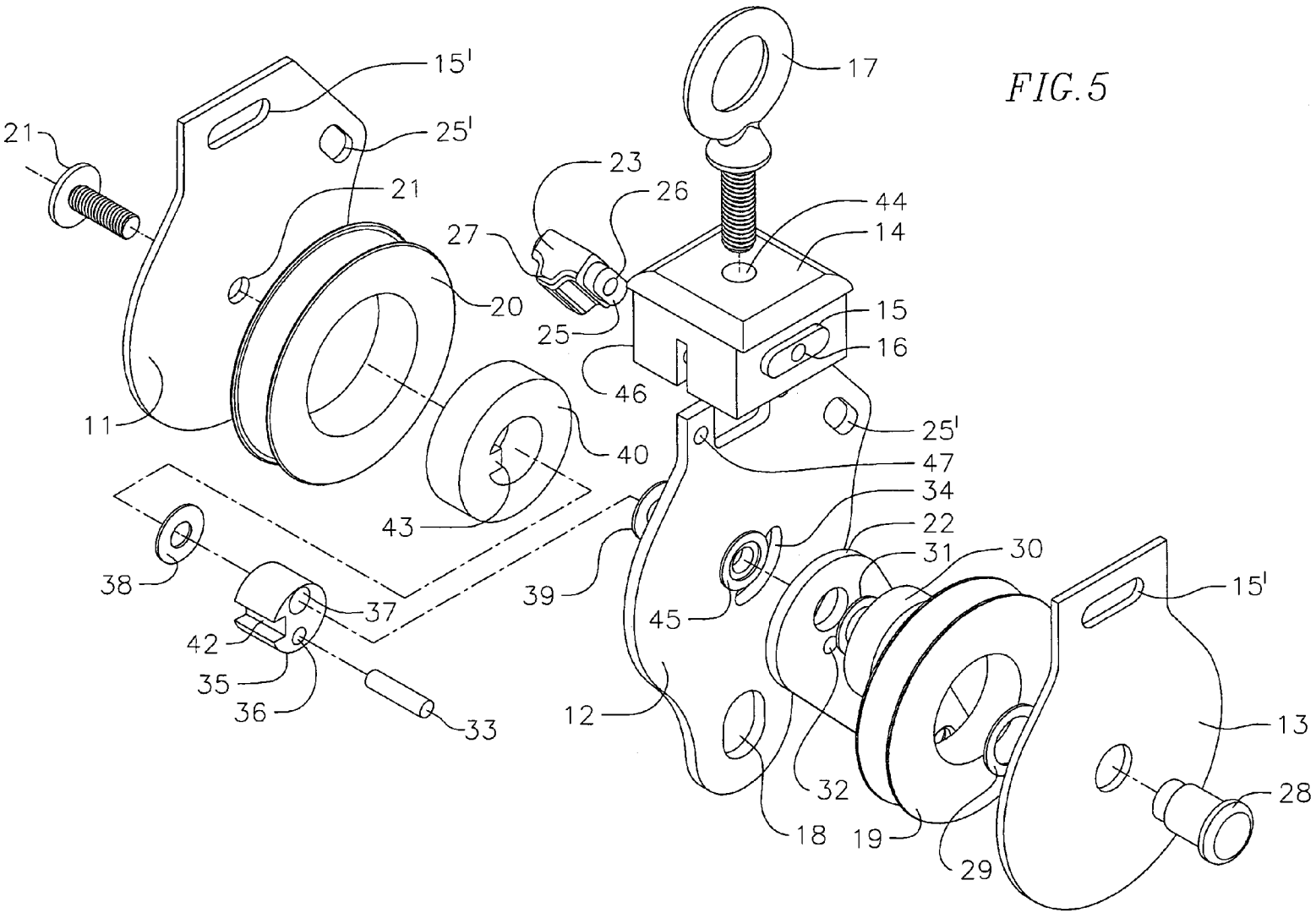
FIG. 5 is an exploded rear perspective view of the self-camming pulley according to an exemplary embodiment of the present invention.
Figure 6:
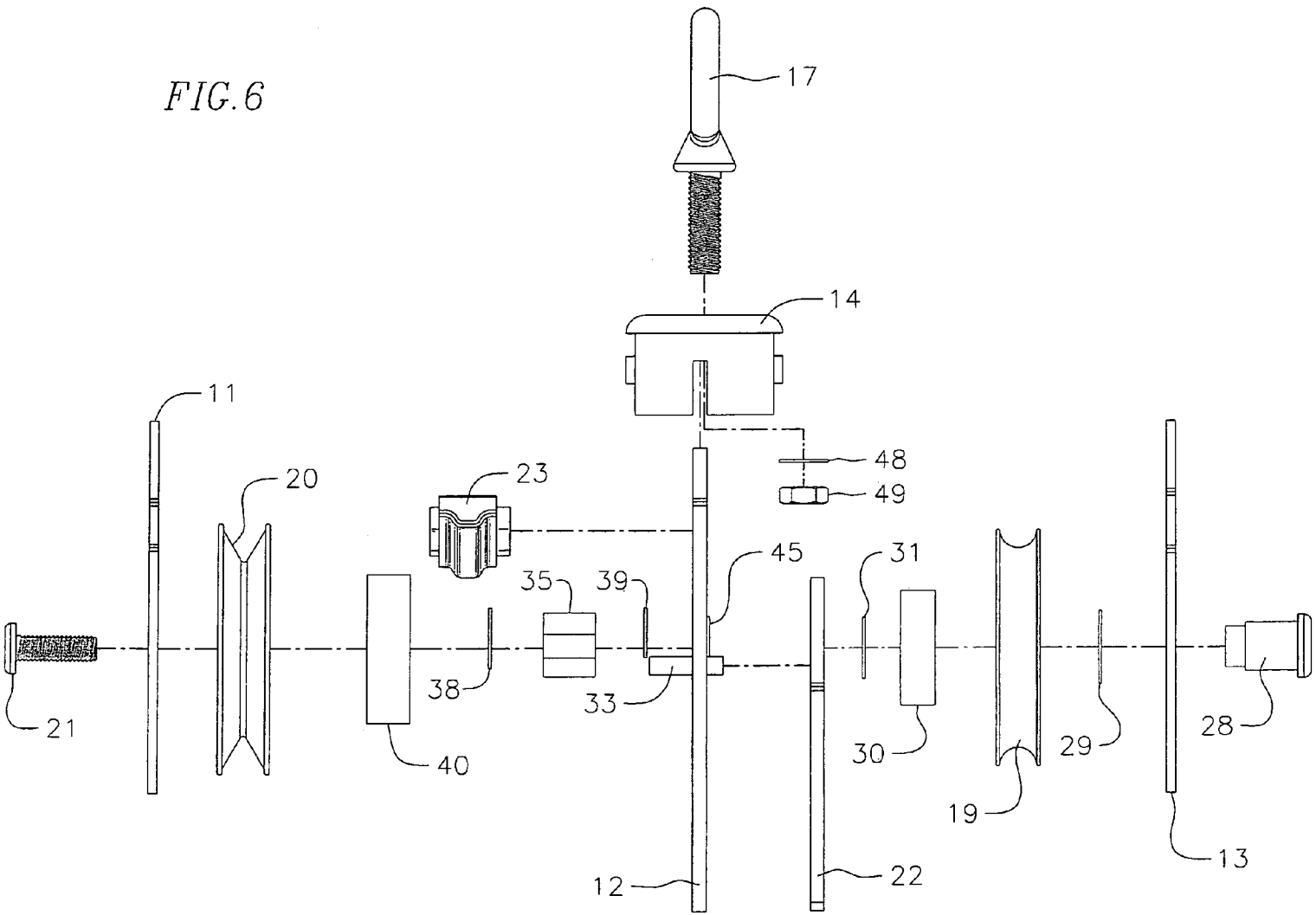
FIG. 6 is an exploded front perspective view of the self-camming pulley according to an exemplary embodiment of the present invention.

FIGS. 5 and 6 are an exploded rear perspective view of the self-camming pulley 10 according to an exemplary embodiment of the present invention. As described above, front and rear plates 11, 13 are secured to the main block 14. The main block 14 includes a swiveling eyebolt 17. The swiveling eyebolt 17 is inserted into hole 44 of the main block 14 and secured to the main block 14 with a washer and nut 48, 49 from a bottom portion of the main block 14. The main block 14 includes holes 46 for allowing bolts or screws to be inserted for attaching the middle plate 12 at hole openings 47 to the main block 14. The main block 14 also includes protrusions 15 that fit into protrusion openings 15' of the plates and a hole 16 such that the main block 14 may be fixed to the plates 11, 13 by insertion of a bolt, the bolt head having a larger diameter than the width of the protrusion openings 15'. As discussed above, the protrusions 15 and corresponding protrusion openings 15' increase the strength of the pulley 10 and allow the plates 11, 13 to be aligned properly to the fixed block/brake pad 23.

The fixed block/brake pad 23 also includes protrusions 25 and holes 26 for being fixed between the front and middle plates 11, 12 at protrusion openings 25'. The rear axle 28 fits into a center hole of the rear plate 13. A washer 29 fits over the rear axle 28 to keep the bearing 30 from rubbing against an inside of the rear plate 13. The bearing 30 allow the sheave 19 to freewheel in both directions. The bearing 30 may be Oilite® bronze bushings or a sealed ball bearing, as are common in rescue pulleys. Oilite® is a registered trademark of Beemer Precision, Inc. Oilite® bushings are less expensive, but may require more maintenance and cleaning than a sealed ball bearing, particularly when used in dirty environments. Furthermore, Oilite® bushings normally have more friction than ball bearing pulleys.

A washer 31 separates the bearing 30 from the lever 22. Washer 45 separates the lever 22 from the middle plate 12. The middle plate 12 includes an opening 34 adjacent a center hole for allowing dowel pin 33 to be inserted thereto. The dowel pin 33 fits into hole 32 of lever 22. The dowel pin 33 also fits into hole 36 of sheave hub 35. The sheave hub 35 includes a front axle hole 37. The sheave hub 35 also includes a keyway 42 for securing key 43 of the one-way bearing 40 to the sheave hub 35 to prevent rotation of the sheave hub 35 within the one-way bearing 40. The sheave hub 35 is concentrically mounted into the one-way bearing 40 and the sheave 20 such that the sheave hub 35, one-way bearing 40, and the sheave 20 are all eccentrically mounted with respect to the front and rear axle 21, 28. Washer 39 keeps a first end of the sheave hub 35 from rubbing against an inside surface of the middle plate 12. Washer 38 keeps a second end of the sheave hub from rubbing against an inside surface of the front plate 11. The one-way bearing 40 may be a sprag clutch or a ratchet and pawl. The front axle 21 screws into the second axle 28.

As discussed above, the sheave 20 freewheels in one direction (clockwise direction as viewed in FIG. 5). When the sheave 20 is counter rotated (turned in the counter-clockwise direction as viewed in FIG. 5), the sheave hub 35 is also rotated, thus moving the dowel pin 33 in opening 34 of the middle plate. Because the dowel pin 33 is also connected to the lever 22 via hole 32, the lever moves to an upper position upon a counter rotation of the sheave 20. When the lever 22 is in an upper position, the rope is locked between the sheave 20 and the fixed block/brake pad 23. Operators of the self-camming pulley may unlock the rope by pulling down the lever (e.g., by pulling on a cord attached to hole 24 of lever 22), which forward rotates the sheave 20 and moves sheave 20 farther from the fixed block/brake pad 23 such that a rope pinched or compressed between the sheave 20 and fixed block/brake pad 23 is unlocked or disengaged.

Figure 7:
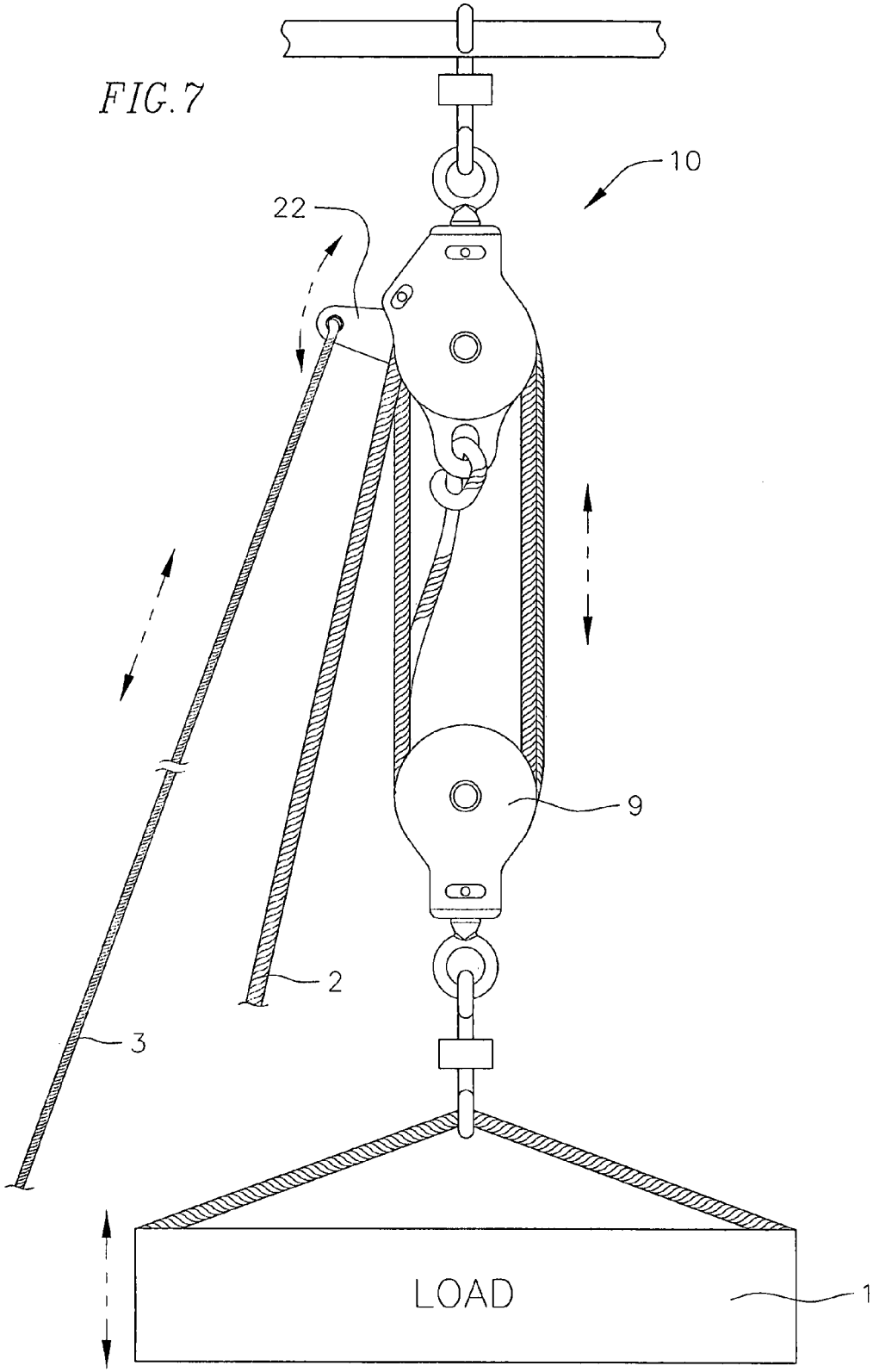
FIG. 7 shows the self-camming pulley in a block and tackle arrangement.

FIG. 7 shows the self-camming pulley 10 in a block and tackle arrangement. A block and tackle is a system of two or more pulleys with a rope or cable threaded between them, usually used to lift or pull heavy loads. Each pulley is called a "block." The whole assembly including the rope is called the "tackle." A common block and tackle arrangement is shown in FIG. 7. FIG. 7 shows a block and tackle arrangement in which there are four lines running between the self-camming pulley 10 and the pulley 9. Thus, the load 1 may be lifted by applying a force equal to approximately one fourth that normally required to lift the load 1. That is, the load 1 may be lifted with a mechanical advantage of approximately four. The mechanical advantage will be slightly less than four due to friction of the sheaves and the weight of the pulley 9.

Referring to FIG. 7, the self-camming pulley 10 is in a fixed position. Pulley 9 moves up and down with the load 1. As the rope 2 is pulled, the load 1 is lifted up. As the load 1 is raised, the sheave 20 freewheels, as does sheave 19 and the sheaves of pulley 9. When the rope 2 is released, the rope 2 is pulled in the opposite direction by the load 1. As the rope 2 is pulled in the opposite direction by the load 1, the rope 2 counter rotates the sheave 20, thus causing the lever 22 to move into an upper position and causing the sheave 20 to move closer to the fixed block/brake pad 23. The fixed block/brake pad 23 locks the rope 2 into place, thus preventing the load 1 from being released. An operator may release the load 1 by pulling on the cord 3 attached to lever 22, which forward rotates sheave 20 and moves sheave 20 farther from the fixed block/brake pad 23, thus unlocking the rope 2 and allowing the load 1 to be lowered.

Although FIG. 7 shows the self-camming pulley 10 used in a block and tackle arrangement with dual sheave pulleys, the self-camming pulley 10 may contain any number of concentrically mounted sheaves 19. In the exemplary embodiments shown in FIGS. 1 through 6, the self-camming pulley includes one concentrically mounted sheave 19. Alternatively, the self camming pulley 10 may have no concentrically mounted sheaves 19, thus allowing the self-camming pulley 10 to be used in block and tackle arrangements with a mechanical advantage of no more than 2. Or, alternatively, the self-camming pulley 10 may include two or three concentrically mounted sheaves 19, thus allowing the self-camming pulley 10 to be used in block and tackle arrangements with a mechanical advantage of up to six or eight, respectively. As can be appreciated by the above discussion, the self-camming pulley 10 may contain any number of concentrically mounted sheaves 19.

As discussed in relation to FIG. 7, there is a counter force on the rope 2 that is a function of the load and the mechanical advantage of the particular block and tackle arrangement. Thus, in a block and tackle arrangement as shown in FIG. 7, the counter force on rope 2 is equal to approximately one fourth that normally required to lift the load. If the rope 2 is released, that force may be insufficient to cause the rope 2 to make sufficient contact with the sheave 20 in order to counter rotate it (e.g., with light loads and/or high mechanical advantage block and tackle arrangements and/or a stiff rope), thus allowing the rope 2 to be released without pulling down on lever 22. The particular problem is solved by addition of a mechanism for pulling the release arm lever 22 to an upper position when the rope 2 is released.

Figure 8:
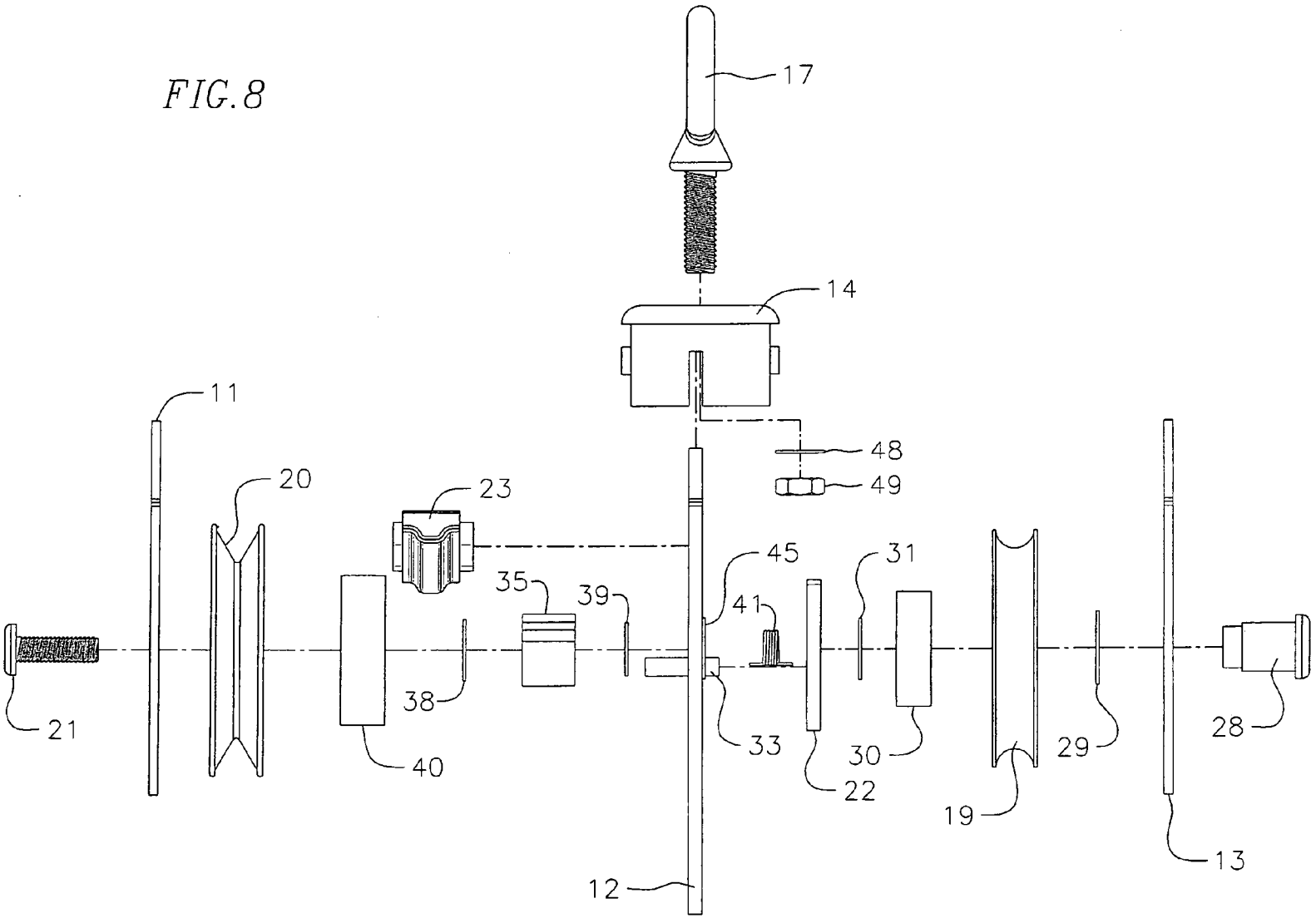
FIG. 8 is an exploded side view of a self-camming pulley according to another exemplary embodiment of the present invention.

FIG. 8 is an exploded side view of a self-camming pulley 10' according to another exemplary embodiment of the present invention. The self-camming pulley 10' may additionally include a torsion spring 41 attached to lever 22 and middle plate 12. Alternatively, the torsion spring 41 may be connected between the sheave hub 35 and the middle plate 12. The torsion spring 41 provides an additional mechanism to bias the lever 22 into an upper position, thus aiding to overcome the problem of the rope slipping due to a stiff rope, light loads, and/or high mechanical advantage block and tackle arrangements. The torsion spring 41 torsion coefficient must be high enough to provide a sufficient bias on the lever 22, but low enough such that it does not bias the lever 22 such that it would be difficult for an operator to lift a load.

FIG. 9 is a rear perspective view of a self-camming pulley 10' according to yet another exemplary embodiment of the present invention. As described above in relation to FIG. 1, the lever 22' may alternatively be located on a rear side of the pulley 10'. Such an arrangement allows the pulley 10' to be used in a block and tackle arrangement in which the pulley 10' is the moving pulley and the pulley 9 (see FIG. 7) is in a fixed position. In such an arrangement, the pulley 9 would include an eye to which a rope can be tied and pulley 10' would be flipped upside down.

Locating the lever 22' on an opposite side reverses when the lever 22' releases a load. That is, when the lever 22' is in a lower position as depicted in FIG. 9, the sheave 20 is located closer to the fixed block/brake pad 23 than when the lever is in an upper position. This allows for an operator to pull down on the lever 22' to release a load while the pulley 10' is used upside down as a moving pulley in a block and tackle arrangement.

Figure 10:
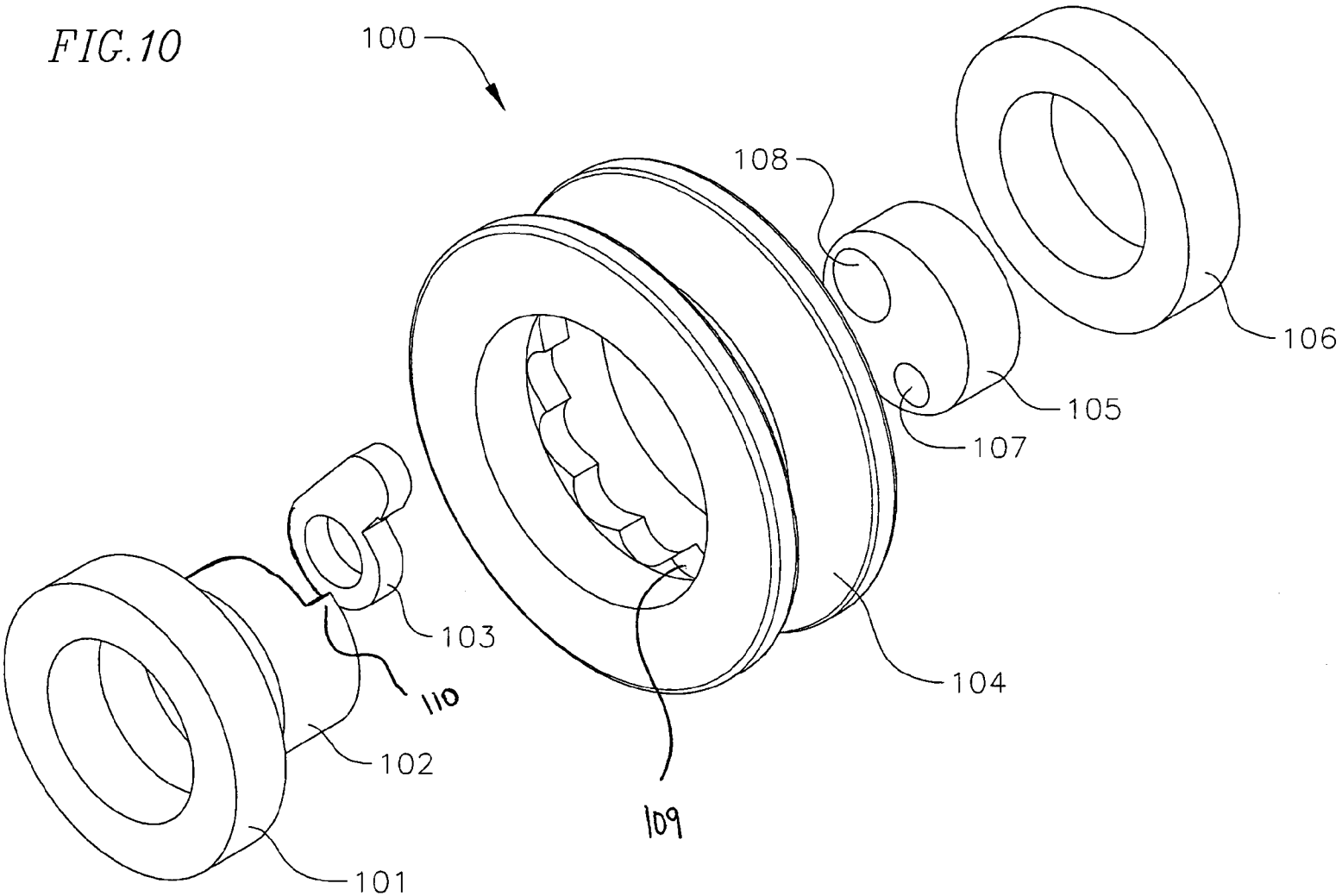
FIG. 10 is a perspective view of a ratchet and pawl sheave apparatus according to an exemplary embodiment of the present invention.

FIG. 10 is a perspective view of a ratchet and pawl sheave apparatus 100 according to an exemplary embodiment of the present invention. The one-way rotation of the sheave 20 (see FIG. 5) may be accomplished with a ratchet and pawl (or dog and pawl) sheave apparatus 100 as shown in FIG. 10. The ratchet and pawl sheave apparatus 100 includes a V-grooved sheave 104 having a circular hollow interior with dogs 109 arranged in the circular hollow interior. The ratchet and pawl sheave apparatus 100 further includes a pawl 103 mounted eccentrically to the sheave 104 and shafted by the axle 21 (see FIG. 5). The pawl 103 has a flange adapted to engage the dogs 109 as the sheave 104 is counter rotated. The pawl 103 is encased by a split hub 102, 105. Hub 105 includes a hole 107 for a dowel pin 33 (see FIG. 5) and a hole 108 for the axle 21. Hub 102 also includes a hole 108 for the axle 21. In one embodiment, hub 102 has an edge protrusion 110 for keeping the flange of the pawl 103 in position such that the pawl 103 will engage the dogs 109 when the sheave 104 is counter rotated. Each hub 102, 105 is secured to the sheave 104 with a freewheeling ball bearing assembly 101, 106. This ratchet sheave assembly 100 allows freewheeling in one direction, but if counter rotated, the pawl 103 engages with a dog 109 on the sheave 104 and freewheeling ceases.

While the invention has been described in terms of exemplary embodiments, it is to be understood that the words which have been used are words of description and not of limitation. As is understood by persons of ordinary skill in the art, a variety of modifications can be made without departing from the scope of the invention defined by the following claims, which should be given their fullest, fair scope.

What is claimed is:

1. A pulley comprising:

a first plate;

a second plate arranged adjacent to the first plate and connected to the first plate by an axle;

an eccentrically mounted sheave located between the first plate and the second plate and adapted to freewheel in one direction only, the eccentrically mounted sheave being mounted eccentrically with respect to the axle and adapted to support a line; and a fixed block mounted between the first plate and the second plate and adapted to fixedly lock a line between the fixed block and the eccentrically mounted sheave.

2. The pulley as claimed in claim 1, wherein the eccentrically mounted sheave is adapted to move closer to the fixed block when the eccentrically mounted sheave is rotated in a direction opposite said one direction, and to move farther from the fixed block when the eccentrically mounted sheave is rotated in said one direction.

3. The pulley as claimed in claim 2, further comprising:

a lever coupled to the eccentrically mounted sheave and adapted to move from a first position to a second position when the eccentrically mounted sheave is rotated in the direction opposite said one direction, wherein the lever is also adapted to rotate the eccentrically mounted sheave in said one direction as the lever is moved from the second position to the first position, wherein the lever includes an eye for attaching a cord extension.

4. The pulley as claimed in claim 3, further comprising a torsion spring connected between the lever and the second plate, the torsion spring being adapted to bias the lever from the first position to the second position when a line carried by the eccentrically mounted sheave is released.

5. The pulley as claimed in claim 3, further comprising a main block connecting the first plate and the second plate together at a top portion of the first plate and the second plate.

6. The pulley as claimed in claim 5, further comprising an eyebolt connected to a top of the main block, the eyebolt being adapted to swivel.

7. The pulley as claimed in claim 6, wherein the second plate contains an eye in a bottom portion.

8. The pulley as claimed in claim 7, further comprising:

a third plate arranged adjacent to the second plate, the third plate being attached to the first plate and the second plate by the main block and the axle; and a concentrically mounted sheave located between the second plate and the third plate and adapted to freewheel in both clockwise and counter-clockwise directions, the concentrically mounted sheave being mounted concentrically with respect to the axle.

9. The pulley as claimed in claim 8, further comprising:

a two-way bearing mounted within the concentrically mounted sheave for allowing the concentrically mounted sheave to freewheel in both clockwise and counter-clockwise directions.

10. The pulley as claimed in claim 9, further comprising:

a one-way bearing mounted within the eccentrically mounted sheave for allowing the eccentrically mounted sheave to freewheel in one direction only;

a sheave hub mounted within the one-way bearing, the sheave hub having a sheave hub dowel pin hole and a sheave hub axle hole located off of a center of the sheave hub, wherein the sheave hub, the one-way bearing, and the eccentrically mounted sheave are concentric to one another and are mounted eccentrically with respect to the axle through the sheave hub axle hole;

a dowel pin inserted into the sheave hub dowel pin hole and connected to the lever.

11. The pulley as claimed in claim 9, further comprising:

a ratchet and pawl mounted within the eccentrically mounted sheave for allowing the eccentrically mounted sheave to freewheel in one direction only;

a sheave hub mounted within the ratchet and pawl, the sheave hub having a sheave hub dowel pin hole and a sheave hub axle hole located off of a center of the sheave hub, wherein the sheave hub, the one-way bearing, and the eccentrically mounted sheave are concentric to one another and are mounted eccentrically with respect to the axle through the sheave hub axle hole;

a dowel pin inserted into the sheave hub dowel pin hole and connected to the lever.

12. The pulley as claimed in claim 9, wherein the first plate, the second plate, and the third plate extend beyond the concentrically mounted sheave and eccentrically mounted sheave in order to protect a line carried by the concentrically mounted sheave and eccentrically mounted sheave from external abrasion.

13. The pulley as claimed in claim 9, wherein the main block includes protrusions for fitting into corresponding protrusion openings of the first plate, the second plate, and the third plate; and the fixed block includes protrusions for fitting into corresponding protrusion openings of the first plate and the second plate.

14. The pulley as claimed in claim 9, wherein the concentrically mounted sheave has a rounded inner surface and the eccentrically mounted sheave has an angular inner surface.

15. The pulley as claimed in claim 14, wherein:

the lever is adapted to rotate the first sheave in a direction in which the first sheave freewheels and to rotate the first sheave from a first eccentric position closer to the fixed block to a second eccentric position farther from the fixed block as the lever is moved from a second lever position to a first lever position; and the first sheave is adapted to move the lever from the first lever position to the second lever position when the first sheave is rotated in a direction opposite the direction in which the first sheave freewheels.

16. The pulley as claimed in claim 15, further comprising a torsion spring connected between the lever and the sheave hub, the torsion spring being adapted to bias the lever from the first lever position to the second lever position when force on a line carried by the eccentrically mounted sheave is released.

17. A pulley comprising:

a front plate;

a middle plate arranged adjacent to the front plate, the middle plate having an eye located at a bottom portion;

a rear plate arranged parallel to the front plate and the middle plate;

an axle connecting the front plate, the middle plate, and the rear plate together in a center portion of the front plate, the middle plate, and the rear plate;

a main block connecting the front plate, the middle plate, and the rear plate together at an upper portion;

a first sheave located between the front plate and the middle plate, the first sheave being mounted eccentrically with respect to the axle, the first sheave being adapted to freewheel in one direction only;

a second sheave located between the middle plate and the rear plate, the second sheave being adapted to rotate in both a clockwise and counter-clockwise direction;

a eyebolt attached to a top of the main block and adapted to swivel;

a fixed block attached between the front plate and the middle plate, the fixed block being adapted to fixedly lock a line between the fixed block and the first sheave; and a lever coupled to the first sheave.

18. The pulley as claimed in claim 17, further comprising:

a sheave hub mounted within the one-way bearing, the sheave hub having a sheave hub dowel pin hole and a sheave hub axle hole located off of a center of the axle, wherein the sheave hub and the first sheave are concentric to one another and are mounted eccentrically with respect to the axle through the sheave hub axle hole;

a dowel pin inserted into the sheave hub dowel pin hole and connected to the lever.

19. A method of providing a self-locking system on a pulley having a first plate and a second plate, the method comprising:

locating a fixed block between the first plate and the second plate;

mounting a sheave eccentrically with respect to an axle between the first plate and the second plate such that in a first eccentric position the sheave is closer to the fixed block and in a second eccentric position the sheave is farther from the fixed block;

adapting the sheave such that it freewheels in one direction only;

adapting the sheave to rotate to the first eccentric position when force on a line carried by the sheave is released;

adapting the sheave and the fixed block to fixedly lock a line between the fixed block and the sheave when the sheave is in the first eccentric position; and adapting the sheave to rotate to the second eccentric position when force on a line carried by the sheave is applied such that the line is released from between the fixed block and the sheave.

20. The method as claimed in claim 19, the method further comprising:

locating a lever to be in a first lever position when the sheave is in the second eccentric position and in a second lever position when the sheave is in the first eccentric position; and adapting the sheave to rotate to the second eccentric position when the lever is moved from the second lever position to the first lever position.

* * * * *